US010364671B2

(12) United States Patent
Green et al.

(10) Patent No.: US 10,364,671 B2
(45) Date of Patent: Jul. 30, 2019

(54) DIAMOND TIPPED CONTROL VALVE USED FOR HIGH TEMPERATURE DRILLING APPLICATIONS

(71) Applicants: Ryan Damont Green, League City, TX (US); Sebastian Tegeler, Hannover (DE); Andreas Peter, Celle (DE)

(72) Inventors: Ryan Damont Green, League City, TX (US); Sebastian Tegeler, Hannover (DE); Andreas Peter, Celle (DE)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 0 days.

(21) Appl. No.: 15/066,612

(22) Filed: Mar. 10, 2016

(65) Prior Publication Data

US 2017/0260852 A1 Sep. 14, 2017

(51) Int. Cl.
*E21B 41/00* (2006.01)
*E21B 47/18* (2012.01)

(52) U.S. Cl.
CPC ..... *E21B 47/185* (2013.01)

(58) Field of Classification Search
CPC ..... E21B 47/18; E21B 47/185; E21B 34/14
USPC ..... 340/853.6
See application file for complete search history.

(56) References Cited

U.S. PATENT DOCUMENTS 2,278,532 A 4/1942 Crickmer
3,065,416 A 11/1962 Jeter
3,523,676 A 8/1970 Barker
3,958,217 A 5/1976 Spinnler
3,964,556 A 6/1976 Gearhart
4,078,620 A 5/1978 Westlake
4,336,564 A 6/1982 Wisniewski et al.
4,351,037 A 9/1982 Scherbatskoy
4,386,422 A 5/1983 Mumby
4,515,225 A 5/1985 Dailey
4,550,392 A 10/1985 Mumby
4,628,495 A 12/1986 Peppers
4,719,979 A * 1/1988 Jones ..... E21B 10/602 175/339
4,819,745 A 4/1989 Walter
4,825,421 A 4/1989 Jeter
(Continued)

FOREIGN PATENT DOCUMENTS

EP 0088402 A2 9/1983
JP 2003097756 A 4/2003
(Continued)

OTHER PUBLICATIONS

PCT/US2017/021327, ISR/WO issued May 10, 2107, 15 pages.
(Continued)

*Primary Examiner* — Munear T Akki
(74) *Attorney, Agent, or Firm* — Cantor Colburn LLP

(57) ABSTRACT

A control valve assembly includes a body including a mud flow passage having a mud flow inlet and a mud flow outlet, a magnetic plunger slidingly mounted within the body, and a solenoid mounted at the body about the magnetic plunger. The solenoid is selectively activated to shift the magnetic plunger between a first position covering the mud flow outlet and a second position exposing the mud flow outlet allowing a pulse of mud to flow through the mud flow passage.

5 Claims, 4 Drawing Sheets

(56) References Cited

U.S. PATENT DOCUMENTS 4,873,488 A * 10/1989 Barber ..... E21B 17/003 324/339
5,070,595 A 12/1991 Perkins et al.
5,073,877 A 12/1991 Jeter
5,103,430 A 4/1992 Jeter et al.
5,182,731 A 1/1993 Hoelscher
5,275,337 A 1/1994 Kolarik et al.
5,303,776 A * 4/1994 Ryan ..... E21B 23/06 166/147
5,333,686 A 8/1994 Vaughan
5,660,238 A 8/1997 Earl
6,002,643 A 12/1999 Tchakarov
6,016,288 A 1/2000 Frith
6,199,823 B1 3/2001 Dahlgren et al.
6,328,112 B1 12/2001 Malone
6,464,011 B2 10/2002 Tubel
6,555,926 B2 4/2003 Gondron
6,626,244 B2 9/2003 Powers
6,714,138 B1 3/2004 Turner
6,811,135 B2 11/2004 Moreno et al.
6,898,150 B2 5/2005 Hahn
7,350,588 B2 4/2008 Abercrombie Simpson et al.
7,921,876 B2 4/2011 Wright et al.
8,365,821 B2 2/2013 Hall et al.
8,469,104 B2 6/2013 Downton
8,534,381 B1 9/2013 Rinald
8,627,883 B2 1/2014 Richards
8,627,893 B2 1/2014 Otto et al.
8,672,025 B2 3/2014 Wolf et al.
8,905,075 B2 12/2014 Tower
8,912,915 B2 12/2014 Hay et al.
2002/0117644 A1 8/2002 Carrillo et al.
2003/0024706 A1 2/2003 Allamon
2003/0047317 A1* 3/2003 Powers ..... E21B 17/003 166/373
2004/0069530 A1 4/2004 Prain
2007/0056771 A1 3/2007 Gopalan et al.
2008/0236841 A1 10/2008 Howlett et al.
2008/0236842 A1 10/2008 Bhavsar et al.
2009/0114396 A1 5/2009 Kusko et al.
2010/0089587 A1 4/2010 Stout
2010/0102264 A1 4/2010 Bickoff et al.
2010/0195442 A1 8/2010 Reyes et al.
2011/0232791 A1 9/2011 Bengea et al.
2011/0278017 A1 11/2011 Themig et al.
2012/0118582 A1 5/2012 Soni et al.
2012/0261603 A1 10/2012 Kahn et al.
2012/0279723 A1 11/2012 Hofman
2014/0034325 A1 2/2014 Jancha et al.
2014/0284112 A1 9/2014 Cenac et al.
2014/0332277 A1 11/2014 Churchill
2015/0034386 A1 2/2015 Reed et al.
2015/0260014 A1* 9/2015 Zimmerman ..... E21B 41/0085 166/373
2015/0322753 A1* 11/2015 Zimmerman, Jr. ... E21B 43/121 166/372
2016/0265350 A1* 9/2016 Brown-Kerr ..... E21B 47/185
2016/0341001 A1* 11/2016 Scholz ..... E21B 47/185
2017/0260831 A1 9/2017 Green
2017/0260832 A1 9/2017 Green et al.

FOREIGN PATENT DOCUMENTS

WO 2014094150 A1 6/2014
WO 2015017522 A1 2/2015

OTHER PUBLICATIONS

Schlumberger, "High Temperature Drilling Operations", Retrieved from: https://www.s1b.com/~/media/Files/drilling/brochures/drilling_applications/ht_tools_br.pdf; "An Industry Challenge", 12 pages.
Notification of Transmittal of the International Search Report and the Written Opinion of the International Searching Authority PCT/US2017/021329; dated May 10, 2017; 12 pages.
Notification of Transmittal of the International Search Report and the Written Opinion of the International Searching Authority, or the Declaration; PCT/US2017/021331; dated May 31, 2017; 13 pages.

* cited by examiner

DIAMOND TIPPED CONTROL VALVE USED FOR HIGH TEMPERATURE DRILLING APPLICATIONS

BACKGROUND

Downhole operations often include a downhole string that extends from an uphole system into a formation. The uphole system may include a platform, pumps, and other systems that support resource exploration, development, and extraction. In some instances, fluids may be passed from the uphole system into the formation through the downhole string. In other instances, fluid may pass from the formation through the downhole string to the uphole system. The downhole string may include various sensors that detect downhole parameters including formation parameters and parameters associated with the downhole string.

It is desirable to communicate information from downhole sensors to the uphole system. Communication may take place through wired, optical, or acoustical systems. Acoustical systems rely upon passage of pressure pulses generated downhole to an uphole receiver. The pressure pulses are created by moving a piston through a hydraulic fluid. The uphole receiver converts the pressure pulses to data indicative of sensed parameters. The pressure pulses provide useful information to uphole operators. Therefore, advances in downhole communication systems would be well received by resource exploration and recovery companies.

SUMMARY

A control valve assembly includes a body including a mud flow passage having a mud flow inlet and a mud flow outlet, a magnetic plunger slidingly mounted within the body, and a solenoid mounted at the body about the magnetic plunger. The solenoid is selectively activated to shift the magnetic plunger between a first position covering the mud flow outlet and a second position exposing the mud flow outlet allowing a pulse of mud to flow through the mud flow passage.

A resource exploration system includes an uphole system, and a downhole system including a downhole string operatively connected to the uphole system. The downhole string includes a pulser alternator generator having a main valve assembly, an alternator, and a control valve assembly operatively connected to the main valve assembly and the alternator. The control valve assembly includes a body including a mud flow passage having a mud flow inlet and a mud flow outlet, a magnetic plunger slidingly mounted within the body, and a solenoid mounted at the body about the magnetic plunger. The solenoid is selectively activated to shift the magnetic plunger between a first position covering the mud flow outlet and a second position exposing the mud flow outlet allowing a pulse of mud to flow through the mud flow passage.

BRIEF DESCRIPTION OF THE DRAWINGS

Referring now to the drawings wherein like elements are numbered alike in the several Figures.

DETAILED DESCRIPTION

Figure 1:
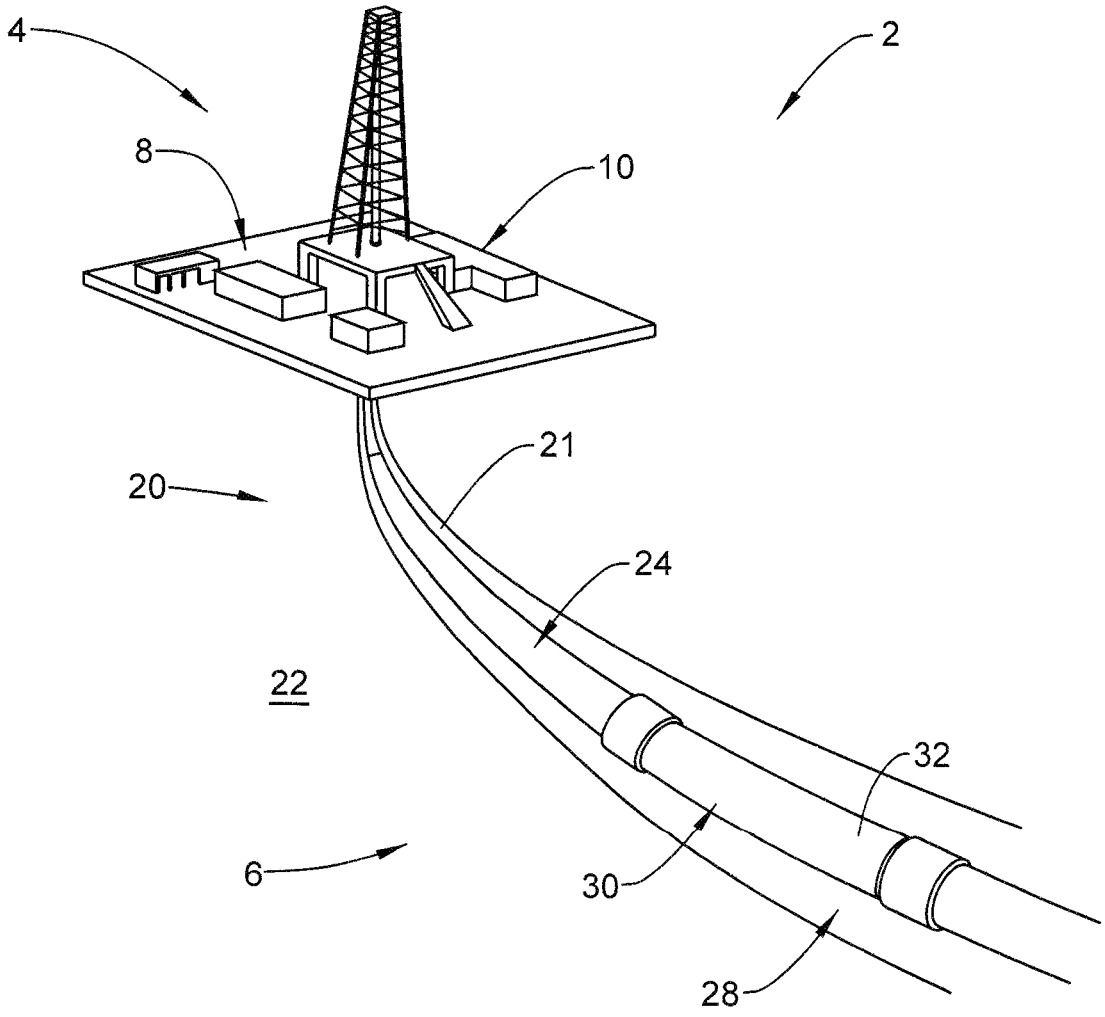
FIG. 1 depicts a resource exploration system having an uphole system operatively connected to a downhole string including a pulser alternator generator (PAG) having a plunger-type control valve assembly, in accordance with an exemplary embodiment.

A resource exploration system, in accordance with an exemplary embodiment, is indicated generally at 2, in FIG. 1. Resource exploration system 2 should be understood to include well drilling operations, resource extraction and recovery, $CO_2$ sequestration, and the like. Resource exploration system 2 may include an uphole system 4 operatively connected to a downhole system 6. Uphole system 4 may include pumps 8 that aid in completion and/or extraction processes as well as fluid storage 10. Fluid storage 10 may contain a gravel pack fluid or slurry (not shown) that is introduced into downhole system 6.

Downhole system 6 may include a downhole string 20 that is extended into a wellbore 21 formed in formation 22. Downhole string 20 may include a number of connected downhole tools or tubulars 24. One of tubulars 24 may include a pulser alternator generator (PAG) assembly 28. PAG assembly 28 may receive signals from one or more sensors (not shown) indicating one or more of formation parameters, downhole fluid parameters, tool condition parameters and the like. PAG assembly 28 creates one or more pressure pulses that are received at uphole system 4. The one or more pressure pulses define a code that may contain information regarding data received by the sensors. In accordance with an exemplary embodiment, PAG assembly 28 creates pressure pulses by selectively stopping a flow of pressurized downhole fluid or mud as will be detailed more fully below.

Figure 2:
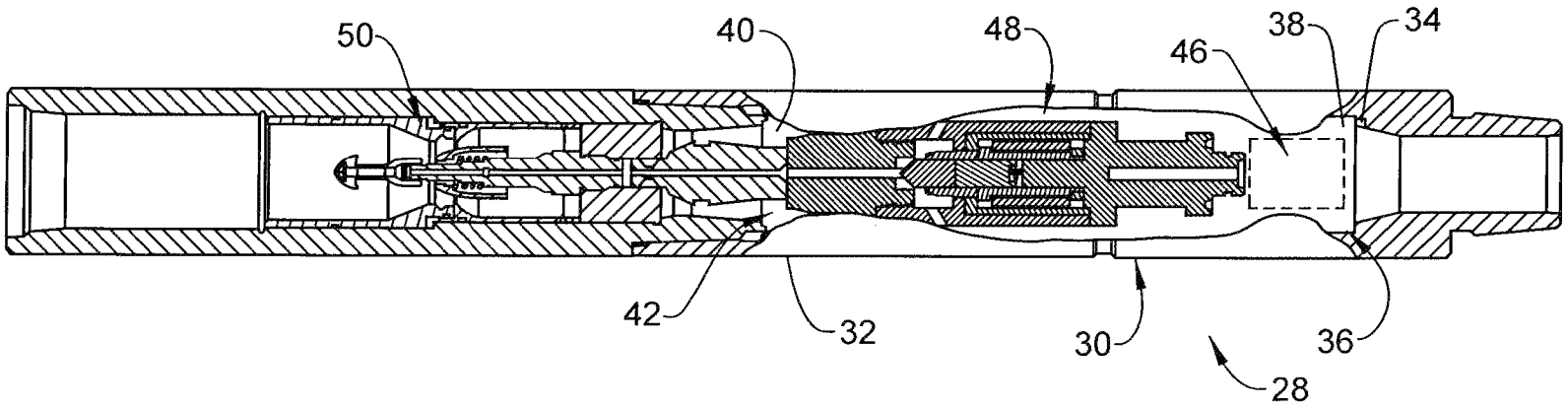
FIG. 2 depicts a partial cross-sectional view of the PAG of FIG. 1.

In accordance with an exemplary embodiment illustrated in FIG. 2, PAG assembly 28 includes a body portion 30 having an outer surface portion 32 and an inner portion 34. An inner housing 36 is arranged within inner portion 34. Inner housing 36 includes an outer surface 38 and an inner surface 40 that defines an interior portion 42. Interior portion 42 houses an alternator assembly 46, a control valve assembly (CVA) 48, and a main valve assembly (50) having a mud flow inlet portion (not separately labeled) and a mud flow outlet portion (also not separately labeled). As will be detailed more fully below, alternator assembly 46 provides signals to CVA 48 that allow drilling mud to flow through MVA 50. CVA 48 creates pressure pulses in the mud flow that provide downhole data from sensors (not shown) operatively coupled to alternator assembly 46 to uphole operators.

Figure 3:
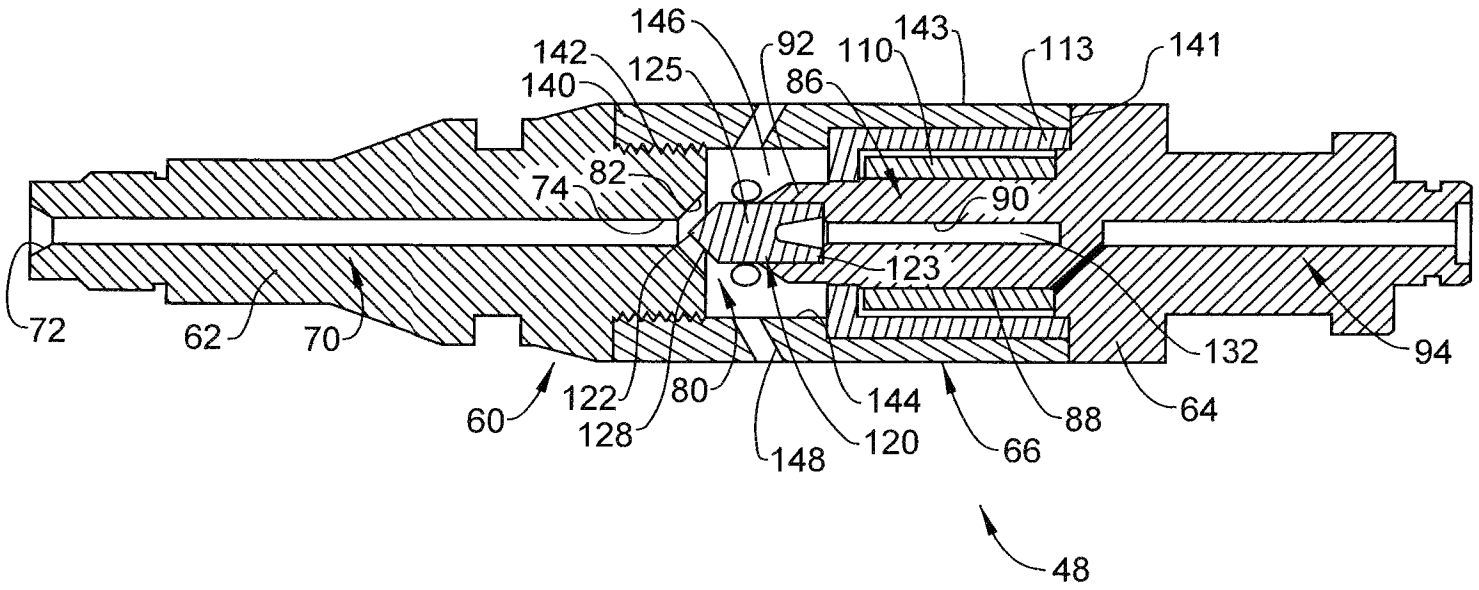
FIG. 3 depicts a cross-sectional view of a plunger-type control valve, in accordance with an aspect of an exemplary embodiment.

As shown in FIG. 3, CVA 48 includes a body 60 having a first body portion 62 mechanically linked to a second body portion 64 by a sleeve member 66. First and second body portions 62 and 64 as well as sleeve member 66 may be formed from 9Cr. In this manner, first and second body portions 62 and 64 and sleeve member 66 may withstand prolonged exposure to downhole fluids. First body portion 62 includes a mud flow passage 70 having a mud flow inlet 72 fluidically connected to MVA 50 and a mud flow outlet 74.

A valve seat 80 is arranged at mud flow outlet 74. Valve seat 80 includes a taper 82. Second body portion 64 includes a plunger support 86 having an outer surface section 88 and a central passage 90. Plunger support 86 also includes a cantilevered end portion (not separately labeled) that defines a valve carrier 92. Second body portion 64 is also shown to include a conductor passage 94. A solenoid 110 is supported on plunger support 86. Solenoid 110 is operatively connected to alternator assembly 46 though a conductor (not shown) extending through conductor passage 94. Solenoid 110 is surrounded by a pressure sleeve 113 that may be formed from 9Cr to provide protection from corrosive downhole fluids.

CVA 48 also includes a magnetic plunger 120 slidingly supported relative to plunger support 86. Magnetic plunger 120 includes a first end portion 122, a second end portion 123 and an intermediate portion 125 extending therebetween. First end portion 122 includes a tapered surface 128 that is selectively received by taper 82 of valve seat 80. Magnetic plunger 120 may be formed from diamond coated 9Cr. An actuation rod 132 is supported at second end portion 123. Actuation rod 132 may be formed from a material that is responsive to a magnetic field produced by solenoid 110.

Sleeve member 66 includes a first end section 140 and a second end section 141. First end section 140 includes a plurality of threads 142 that engage with first body portion 62. Second end section 141 may be press fit to second body portion 64. Of course, it should be understood that the type of attachment to first and second body portions 62 and 64 may vary. Sleeve member 66 also includes an outer surface 143 and an inner surface 144 that defines, at least in part, a mud flow outlet chamber 146. A plurality of outlet ports 148 extend from inner surface 144 through outer surface 143. Outlet ports 148 allow mud to flow through mud flow passage 70, into mud flow outlet chamber 146 and be directed onto inner surface 40 of housing 36.

In accordance with an aspect of an exemplary embodiment, outlet ports 148 may extend at an angle of between about 20° and about 80° relative to a longitudinal axis (not separately labeled) of CVA 48. In accordance with another aspect, outlet ports 148 may extend at an angle of about 60° relative to the longitudinal axis. In this manner, impact forces associated with pulses of mud passing from outlet ports 148 onto inner surface 40 may be reduced over those which would be realized if outlet ports 270 extended perpendicularly to the longitudinal axis.

With this arrangement, alternator assembly 46 provides signals to selectively de-activate solenoid 110 which allows mud flow pressure to shift magnetic plunger 120 from the first position to a second position (FIG. 3). Solenoid 110 may then be activated to return magnetic plunger 120 to the first position. In the second position, mud may flow through mud flow outlet 74, into mud flow outlet chamber 146 and be expelled through outlet ports 148. When operated rapidly, pulses of mud pass from outlet ports 148 contact inner surface 40 of inner housing 36. An uphole receiver captures pressure waves created by the pulses of mud. The pressure pulses are presented in a pattern dictated by signals received from one or more sensors at alternator assembly 46. The pressure pulses may be decrypted to provide data regarding one or more downhole parameters to uphole operators.

Figure 4:
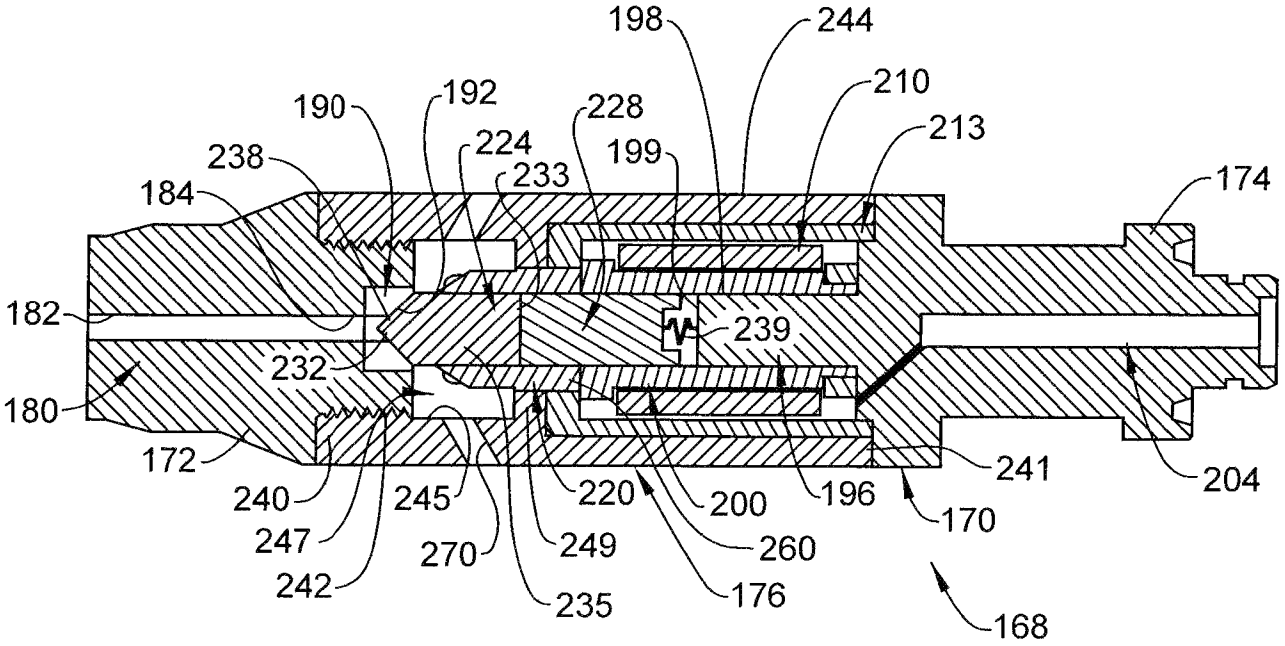
FIG. 4 depicts a cross-sectional view of a plunger-type control valve in accordance with another aspect of an exemplary embodiment.

Reference will now follow to FIG. 4 in describing a control valve assembly (CVA) 168 in accordance with another aspect of an exemplary embodiment. CVA 168 includes a body 170 having a first body portion 172 mechanically linked to a second body portion 174 by a sleeve member 176. First and second body portions 172 and 174 as well as sleeve member 176 may be formed from 9Cr. In this manner, first and second body portions 172 and 174 and sleeve member 176 may withstand prolonged exposure to downhole fluids. First body portion 172 includes a mud flow passage 180 having a mud flow inlet 182 fluidically connected to MVA 50 and a mud flow outlet 184.

A valve seat 190 is arranged at mud flow outlet 184. Valve seat 190 includes a taper 192. Second body portion 174 includes a plunger support 196 having an outer surface section 198 and an axial end section 199. A solenoid carrier 200 is mounted to plunger support 196. Second body portion 174 is also shown to include a conductor passage 204. A solenoid 210 is mounted to and/or carried by solenoid carrier 200. Solenoid 210 is operatively connected to alternator assembly 46 though a conductor (not shown) extending through conductor passage 204. Solenoid 210 is surrounded by a pressure sleeve 213 that may be formed from 9Cr to provide protection from corrosive downhole fluids.

CVA 168 also includes a magnetic plunger 220 slidingly supported relative to solenoid carrier 200. Magnetic plunger 220 includes a valve portion 224 and a piston portion 228. Piston portion 228 is formed from a material, such as 9Cr, that is responsive to a magnetic field produced by solenoid 210. Valve portion 224 includes a first end portion 232, a second end portion 233 and an intermediate portion 235 extending therebetween. First end portion 232 includes a tapered surface 238 that is received by taper 192 of valve seat 190. Valve portion 224 of magnetic plunger 220 may be formed from diamond coated 9Cr. A spring 239 may be arranged between axial end section 199 of plunger support 196 and piston portion 228. Spring 239 biases magnetic plunger 220 toward valve seat 190.

Sleeve member 176 includes a first end section 240 and a second end section 241. First end section 240 includes a plurality of threads 242 that engage with first body portion 172. Second end section 241 may be press fit to second body portion 174. Of course, it should be understood that the type of attachment to first and second body portions 172 and 174 may vary. Sleeve member 176 also includes an outer surface 244 and an inner surface 245 that defines, at least in part, a mud flow outlet chamber 247. An annular flange 249 extends radially inwardly from inner surface 245. Annular flange 249, together with pressure sleeve 213, supports a valve carrier 260 which, in turn, supports magnetic plunger 220. A plurality of outlet ports 270 extend from inner surface 245 through outer surface 246. Outlet ports 270 allow mud to flow through mud flow passage 180, into mud flow outlet chamber 247 and be directed onto inner surface 40 of housing 36.

In accordance with an aspect of an exemplary embodiment, outlet ports 270 may extend at an angle of between about 20° and about 80° relative to a longitudinal axis (not separately labeled) of CVA 168. In accordance with another aspect, outlet ports 270 may extend at an angle of about 60° relative to the longitudinal axis. In this manner, impact forces associated with pulses of mud passing from outlet ports 270 onto inner surface 40 may be reduced over those which would be realized if outlet ports 270 extended perpendicularly to the longitudinal axis.

With this arrangement, alternator assembly 46 provides signals to selectively activate solenoid 110 causing magnetic plunger 120 to shift from a first position (FIG. 4) to a second position (not shown) wherein valve seat 190 is uncovered. Solenoid 210 may then be de-activated allowing spring 239 to bias magnetic plunger 220 back to the first position. In the second position, mud may flow through mud flow outlet 184, into mud flow outlet chamber 247 and be expelled through outlet ports 270. When operated rapidly, pulses of mud pass from outlet ports 270 and contact inner surface 40 of inner housing 36. An uphole receiver captures pressure waves created by the pulses of mud. The pressure pulses are presented in a pattern dictated by signals received from one or more sensors at alternator assembly 46. The pressure pulses may be decrypted to provide data regarding one or more downhole parameters to uphole operators.

Set forth below are some embodiments of the foregoing disclosure:

Embodiment 1

A control valve assembly comprising: a body including a mud flow passage having a mud flow inlet and a mud flow outlet; a magnetic plunger slidingly mounted within the body; and a solenoid mounted at the body about the magnetic plunger, the solenoid being selectively activated to shift the magnetic plunger between a first position covering the mud flow outlet and a second position exposing the mud flow outlet allowing a pulse of mud to flow through the mud flow passage.

Embodiment 2

The control valve assembly according to claim 1, wherein the plunger includes a first end portion, a second end portion and an intermediate portion extending there between, the first end portion including a tapered surface.

Embodiment 3

The control valve assembly according to claim 2, wherein the first end portion is formed from diamond coated 9Cr.

Embodiment 4

The control valve assembly according to claim 1, wherein the body includes a first body portion mechanically joined to a second body portion, the first body portion including a valve seat having a taper receptive of the tapered surface of the first end portion of the magnetic plunger.

Embodiment 5

The control valve assembly according to claim 4, wherein the valve seat is integrally formed in the first body portion.

Embodiment 6

The control valve assembly according to claim 4, wherein the second body portion includes a central passage, the magnetic plunger including an actuation rod extending from the second end portion into the central passage.

Embodiment 7

The control valve assembly according to claim 4, wherein the mud flow passage includes a first end exposed at an external surface of the body exposed at an external surface of the body, the mud flow passage extending through the first body portion to the mud flow outlet exposed within the body.

Embodiment 8

The control valve assembly according to claim 7, further comprising: a sleeve member mechanically linking the first body portion and the second body portion, the sleeve member defining a mud flow outlet chamber fluidically connected to the mud flow outlet.

Embodiment 9

The control valve assembly according to claim 8, wherein the sleeve member includes one or more outlet ports fluidically connected with the mud flow outlet chamber.

Embodiment 10

The control valve assembly according to claim 1, further comprising: a spring member biasing the magnetic plunger in the first position.

Embodiment 11

The control valve assembly according to claim 1, further comprising: a pressure sleeve surrounding the solenoid.

Embodiment 12

The control valve assembly according to claim 1, further comprising: a valve carrier supported in the body, the valve carrier guiding the magnetic plunger between the first and second positions.

Embodiment 13

A resource exploration system comprising: an uphole system; and a downhole system including a downhole string operatively connected to the uphole system, the downhole string including a pulser alternator generator having a main valve assembly, an alternator, and a control valve assembly operatively connected to the main valve assembly and the alternator, the control valve assembly comprising: a body including a mud flow passage having a mud flow inlet and a mud flow outlet; a magnetic plunger slidingly mounted within the body; and a solenoid mounted at the body about the magnetic plunger, the solenoid being selectively activated to shift the magnetic plunger between a first position covering the mud flow outlet and a second position exposing the mud flow outlet allowing a pulse of mud to flow through the mud flow passage.

Embodiment 14

The resource exploration system according to claim 13, wherein the plunger includes a first end portion, a second end portion and an intermediate portion extending therebetween, the first end portion including a tapered surface.

Embodiment 15

The resource exploration system according to claim 14, wherein the first end portion is formed from diamond coated 9Cr.

Embodiment 16

The resource exploration system according to claim 13, wherein the body includes a first body portion mechanically joined to a second body portion, the first body portion including a valve seat having a taper receptive of the tapered surface of the first end portion of the magnetic plunger.

Embodiment 17

The resource exploration system according to claim 16, wherein the second body portion includes a central passage, the magnetic plunger including an actuation rod extending from the second end portion into the central passage.

Embodiment 18

The resource exploration system according to claim 16, wherein the mud flow passage includes a first end exposed at an external surface of the body, the mud flow passage extending through the first body portion to the mud flow outlet exposed within the body.

Embodiment 19

The resource exploration system according to claim 18, further comprising: a sleeve member mechanically linking the first body portion and the second body portion, the sleeve member defining a mud flow outlet chamber fluidically connected to mud flow outlet.

Embodiment 20

The resource exploration system according to claim 19, wherein the sleeve member includes one or more outlet ports fluidically connected with the mud flow outlet chamber.

Embodiment 21

The resource exploration system according to claim 13, further comprising: a spring member biasing the magnetic plunger in the first position.

Embodiment 22

The resource exploration system according to claim 13, further comprising: a pressure sleeve surrounding the solenoid.

Embodiment 23

The resource exploration system according to claim 13, further comprising: a valve carrier supported in the body, the valve carrier guiding the magnetic plunger between the first and second positions.

Embodiment 24

The resource exploration system according to claim 13, further comprising: a spring member biasing the magnetic plunger in the first position.

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc.

The term "about" is intended to include the degree of error associated with measurement of the particular quantity based upon the equipment available at the time of filing the application. For example, "about" can include a range of ±8% or 5%, or 2% of a given value.

While one or more embodiments have been shown and described, modifications and substitutions may be made thereto without departing from the spirit and scope of the invention. Accordingly, it is to be understood that the present invention has been described by way of illustrations and not limitation.

The invention claimed is:

1. A control valve assembly for a downhole string configured to be at least partially filled with mud, the control valve assembly comprising:

a body including a mud flow passage having a mud flow inlet and a mud flow outlet;

a valve seat arranged at one of the mudflow inlet and the mudflow outlet;

a plunger arranged within the body, the plunger abutting the valve seat covering the one of the mudflow inlet and the mudflow outlet, wherein the plunger includes a first end portion, a second end portion and an intermediate portion extending therebetween, the first end portion including a tapered surface, at least one of the first end portion of the plunger and the valve seat is formed from diamond coated material;

a valve carrier supported in the body, the valve carrier extending about and supporting the plunger; and a solenoid mounted at the body about the plunger, the solenoid being selectively energized to shift the plunger from the valve seat allowing a pulse of mud to flow through the mud flow passage.

2. The control valve assembly according to claim 1, wherein the body includes a first body portion mechanically joined to a second body portion, the first body portion including the valve seat having a taper receptive of the tapered surface of the first end portion of the plunger.

3. The control valve assembly according to claim 1, further comprising: a spring member biasing the plunger onto the valve seat.

4. The control valve assembly according to claim 1, further comprising: a pressure sleeve surrounding the solenoid, wherein the pressure sleeve protects the solenoid from mud.

5. The control valve assembly according to claim 1, wherein at least a portion of the plunger is made of magnetic material.

* * * * *